US008313283B2

(12) United States Patent
Morimoto

(10) Patent No.: US 8,313,283 B2
(45) Date of Patent: Nov. 20, 2012

(54) VANE TIP CLEARANCE MANAGEMENT STRUCTURE FOR GAS TURBINE

(75) Inventor: Hitoshi Morimoto, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 949 days.

(21) Appl. No.: 12/066,731

(22) PCT Filed: Sep. 11, 2006

(86) PCT No.: PCT/JP2006/317981
§ 371 (c)(1),
(2), (4) Date: Mar. 13, 2008

(87) PCT Pub. No.: WO2007/032311
PCT Pub. Date: Mar. 22, 2007

(65) Prior Publication Data

US 2009/0180865 A1 Jul. 16, 2009

(30) Foreign Application Priority Data

Sep. 14, 2005 (JP) ..... 2005-266358

(51) Int. Cl.
*F01D 25/00* (2006.01)

(52) U.S. Cl. ..... 415/118; 415/201

(58) Field of Classification Search ..... 415/14, 415/118, 173.1, 201; 416/61
See application file for complete search history.

(56) References Cited

U.S. PATENT DOCUMENTS 3,362,160 A * 1/1968 Bourgeois ..... 60/805
3,936,217 A * 2/1976 Travaglini et al. ..... 415/118
4,011,017 A * 3/1977 Feuerstein et al. ..... 356/241.6
4,300,774 A * 11/1981 Hollis et al. ..... 277/630
4,330,234 A * 5/1982 Colley ..... 415/173.2
(Continued)

FOREIGN PATENT DOCUMENTS

JP 56-164914 A 12/1981
(Continued)

OTHER PUBLICATIONS

International Search Report of PCT/JP2006/317981, date of mailing Dec. 12, 2006.

(Continued)

*Primary Examiner* — Edward Look
*Assistant Examiner* — Jason Davis
(74) *Attorney, Agent, or Firm* — Westerman, Hattori, Daniels & Adrian, LLP

(57) ABSTRACT

Provided is a vane tip clearance management structure for a gas turbine which allows a vane tip clearance to be confirmed easily at the time of completing assembly. For this purpose, there are provided: a casing (3) rotatably supporting a rotor (2); stator vane retainer rings (11, 12, and 13) and a turbine vane ring (16) provided to have predetermined clearances from tips of rotor vanes (10 and 15) fitted in multiple steps to the rotor (2) inside in the radial direction of the casing (3); guide frames (26) penetrating the casing (3), the stator vane retainer rings (11, 12, and 13) and the turbine vane ring (16) in the radial direction and being supported by stepped portions (21*a*, 22*a*, 23*a*, and 24*a*); and rods (25) movably supported by the guide frames (26) and abutting on the tips of the rotor vanes (10 and 15). Clearances (C1 and C2) are measured based on the amounts of movement of the rods (25) relative to the guide frames (26).

3 Claims, 4 Drawing Sheets

U.S. PATENT DOCUMENTS 7,153,023 B2 * 12/2006 Howard et al. ..... 374/144

FOREIGN PATENT DOCUMENTS

| | | | |
|---|---|---|---|
| JP | 63-97898 | A | 4/1988 |
| JP | 6-55385 | A | 3/1994 |
| JP | 8-218809 | A | 8/1996 |
| JP | 11-83470 | A | 3/1999 |
| JP | 2000-136925 | A | 5/2000 |
| JP | 2001-200705 | A | 7/2001 |
| JP | 2004-162536 | A | 6/2004 |

OTHER PUBLICATIONS

Japanese Office Action dated Sep. 14, 2010, issued in corresponding Japanese Patent Application No. 2005-266358 (Partial Translation).

* cited by examiner

VANE TIP CLEARANCE MANAGEMENT STRUCTURE FOR GAS TURBINE

TECHNICAL FIELD

The present invention relates to a vane tip clearance management structure for a gas turbine.

BACKGROUND ART

In general, a gas turbine is configured to obtain a drive force by injecting fuel into air which is compressed at a high temperature with a compressor, generating combustion gas by causing combustion inside a combustor, guiding this combustion gas to a turbine, and thereby rotating the turbine. Moreover, in the compressor and the turbine, a predetermined amount of clearance (tip clearance) is set in a space between tips of rotor vanes arranged in a circumferential direction and a casing provided so as to surround these rotor vanes.

Since the temperature inside the gas turbine becomes high, the difference between the inside and the outside temperatures becomes larger. As a result, the casing is thermally expanded in an axial direction and a circumferential direction thereof and is deformed into an oval shape. Meanwhile, the rotor vanes are also thermally expanded and deformed outward in a radial direction. When the casing and the rotor vanes are deformed as described above, there is a risk that the tips of the rotor vanes contact with the casing and are thereby damaged. Accordingly, the above-mentioned clearance is formed by estimating in advance amounts of thermal deformation of the casing and the rotor vanes at the time of operation. Meanwhile, if the clearance is made larger in order to prevent the contact attributable to the thermal deformation, performance of the entire gas turbine is degraded. Therefore, in view of improvement in performance and improvement in reliability, clearance management or positional management of the casing for forming a predetermined amount of this clearance has become extremely important in recent years.

Thus, conventionally provided are a structure configured to form a predetermined amount of clearance by sequentially stacking each step upward while setting a central shaft of a gas turbine to be perpendicular, or a structure configured to form a predetermined amount of clearance by use of an eccentric pin which is unaffected by the amount of displacement even if there is displacement between casings, or the like. Such conventional vane tip clearance management structures for a gas turbine are disclosed in cited documents 1 and 2, for example.

Patent Document 1: Japanese Patent Application Laid-open Publication No. 2001-200705

Patent Document 2: Japanese Patent Application Laid-open Publication No. 2004-162536

DISCLOSURE OF THE INVENTION

Problem to be Solved by the Invention

However, in a conventional vane tip management structure, a position to dispose the casing and a vane tip clearance are measured at the time of tentatively assembling a gas turbine. The vane clearance is adjusted based on a result of the measurement, and then reassembling is finally performed. Accordingly, it was not possible to check, after the final assembly, whether or not the position to dispose the casing and the vane tip clearance are set to a predetermined position and amount of the clearance. For this reason, it was not possible to surely prevent contact between tips of rotor vanes and the casing when operating the gas turbine.

Therefore, it is an object of the present invention to provide a vane tip clearance management structure for a gas turbine which allows a vane tip clearance to be easily checked at the time of assembly completion.

Means for Solving the Problem

To solve the above mentioned problem, a vane tip clearance management structure for a gas turbine according to a first aspect of the present invention is characterized by including: an outer casing rotatably supporting a rotor; an inner casing provided so as to have a predetermined clearance from tips of rotor vanes which are fitted in multiple steps to the rotor on the inner side of the outer casing in the radial direction; penetrating means which penetrates the outer casing and the inner casing in the radial direction; and abutting means which abuts on the tip of the rotor vane by being moved in the radial direction of the outer casing and the inner casing by use of the penetrating means. Here, the clearance is calculated based on the amount of movement of the abutting means relative to the penetrating means.

To solve the problem, a vane tip clearance management structure for a gas turbine according to a second aspect of the present invention is characterized by including: an outer casing rotatably supporting a rotor; an inner casing provided so as to have a predetermined clearance from tips of rotor vanes which are fitted in multiple steps to the rotor on the inner side of the outer casing in the radial direction; a guide frame penetrating the outer casing and the inner casing in the radial direction and being supported by a supporting surface of the inner casing; and a rod being movably supported by the guide frame and abutting on the tip of the rotor vane. Here, the clearance is calculated based on the length of the guide frame, the length of the rod, the thickness of the inner casing, and the amount of movement of the rod relative to the guide frame.

To solve the problem, a vane tip clearance management structure for a gas turbine according to a third aspect of the present invention is characterized in that, in the vane tip clearance management structure for a gas turbine according to the second aspect, the clearance is calculated by subtracting a difference between the length from a tip of the guide frame to an inner peripheral surface of the inner casing obtained based on the supporting surface and the length from the guide frame to the rod, from the amount of movement of the rod relative to the guide frame.

Effects of the Invention

In the vane tip clearance management structure for a gas turbine of the first aspect of the invention, provided are: the outer casing rotatably supporting a rotor; the inner casing provided so as to have the predetermined clearance from the tips of the rotor vanes which are fitted in the multiple steps to the rotor on the inner side of the outer casing in the radial direction, the penetrating means which penetrates the outer casing and the inner casing in the radial direction, and the abutting means which abuts on the tip of the rotor vane by being moved in the radial direction of the outer casing and the inner casing by use of the penetrating means. Moreover, the clearance is calculated based on the amount of movement of the abutting means relative to the penetrating means. Accordingly, it is possible to check the vane tip clearance easily at the time of completing assembly.

In the vane tip clearance management structure for a gas turbine of the second aspect of the invention, provided are: the outer casing rotatably supporting a rotor; the inner casing provided so as to have the predetermined clearance from the tips of the rotor vanes which are fitted in multiple steps to the rotor on the inner side of the outer casing in the radial direction, the guide frame penetrating the outer casing and the inner casing in the radial direction and being supported by the supporting surface of the inner casing, and the rod being movably supported by the guide frame and abutting on the tip of the rotor vane. Moreover, the clearance is calculated based on the length of the guide frame, the length of the rod, the thickness of the inner casing, and the amount of movement of the rod relative to the guide frame. Accordingly, it is possible to check the vane tip clearance easily at the time of completing assembly.

According to the vane tip clearance management structure for a gas turbine of the third aspect of the invention, in the vane tip clearance management structure for a gas turbine of the second aspect of the invention, the clearance is calculated by subtracting the difference between the length from the tip of the guide frame to the inner peripheral surface of the inner casing obtained based on the supporting surface and the length from the guide frame to the rod, from the amount of movement of the rod relative to the guide frame. Accordingly, it is possible to calculate the vane tip clearance easily.

EXPLANATION OF REFERENCE NUMERALS

1 GAS TURBINE
2 ROTOR
3 CASING (OUTER CASING)
4 AIR INTAKE
5 COMPRESSOR
6 TURBINE
7 CYLINDER
8 COMBUSTOR
9,14 STATOR VANES
10,15 ROTOR VANES
11 FIRST STATOR VANE RETAINER RING (INNER CASING)
12 SECOND STATOR VANE RETAINER RING (INNER CASING)
13 THIRD STATOR VANE RETAINER RING (INNER CASING)
16 TURBINE VANE RING (INNER CASING)
17 to 20 OUTER HOLES
21 to 24 INNER HOLES
21*a* to 24*a* STEPPED PORTIONS
25 ROD
26 GUIDE FRAME
26*a* LARGE DIAMETER PORTION
26*b* SMALL DIAMETER PORTION
26*c* THROUGH HOLE
26*d* SCREW HOLE
26*e* FLANGE PORTION
27 EXTENSION
28 SETSCREW

BEST MODE FOR CARRYING OUT THE INVENTION

Now, a vane tip clearance management structure for a gas turbine according to the present invention will be described below in detail with reference to the accompanying drawings.

Figure 1:
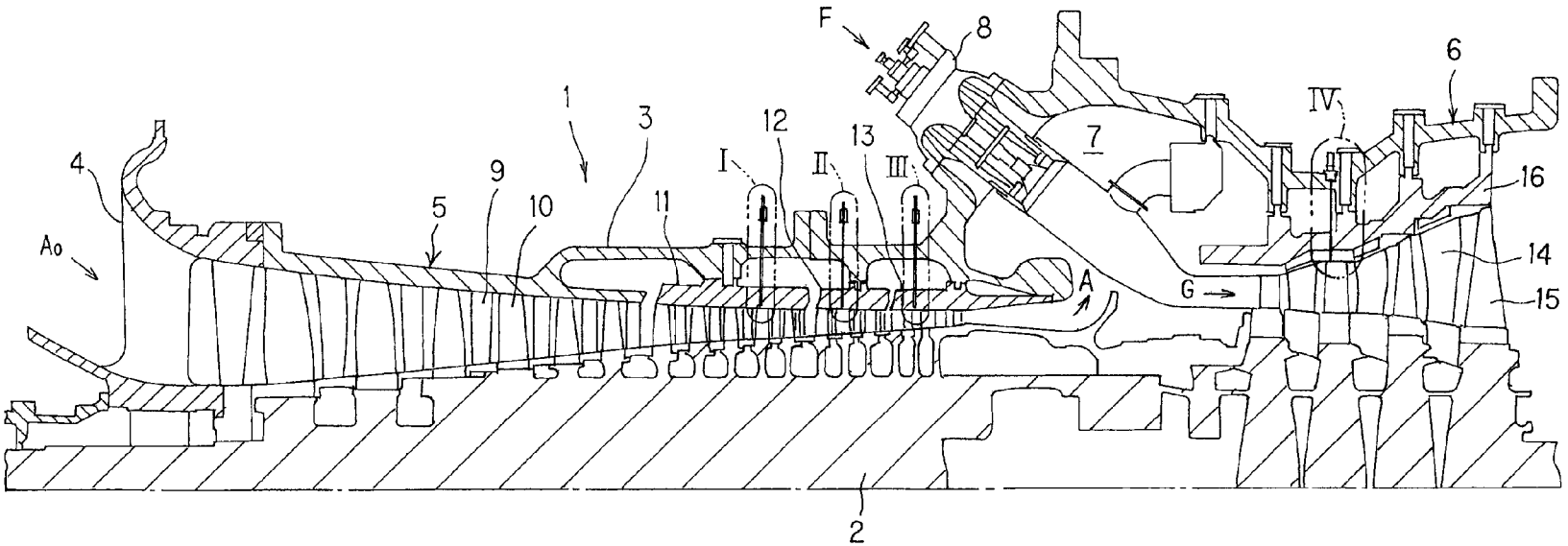
FIG. 1 is a sectional side view of a gas turbine provided with a vane tip management structure for a gas turbine according to an embodiment of the present invention.
Figure 2:
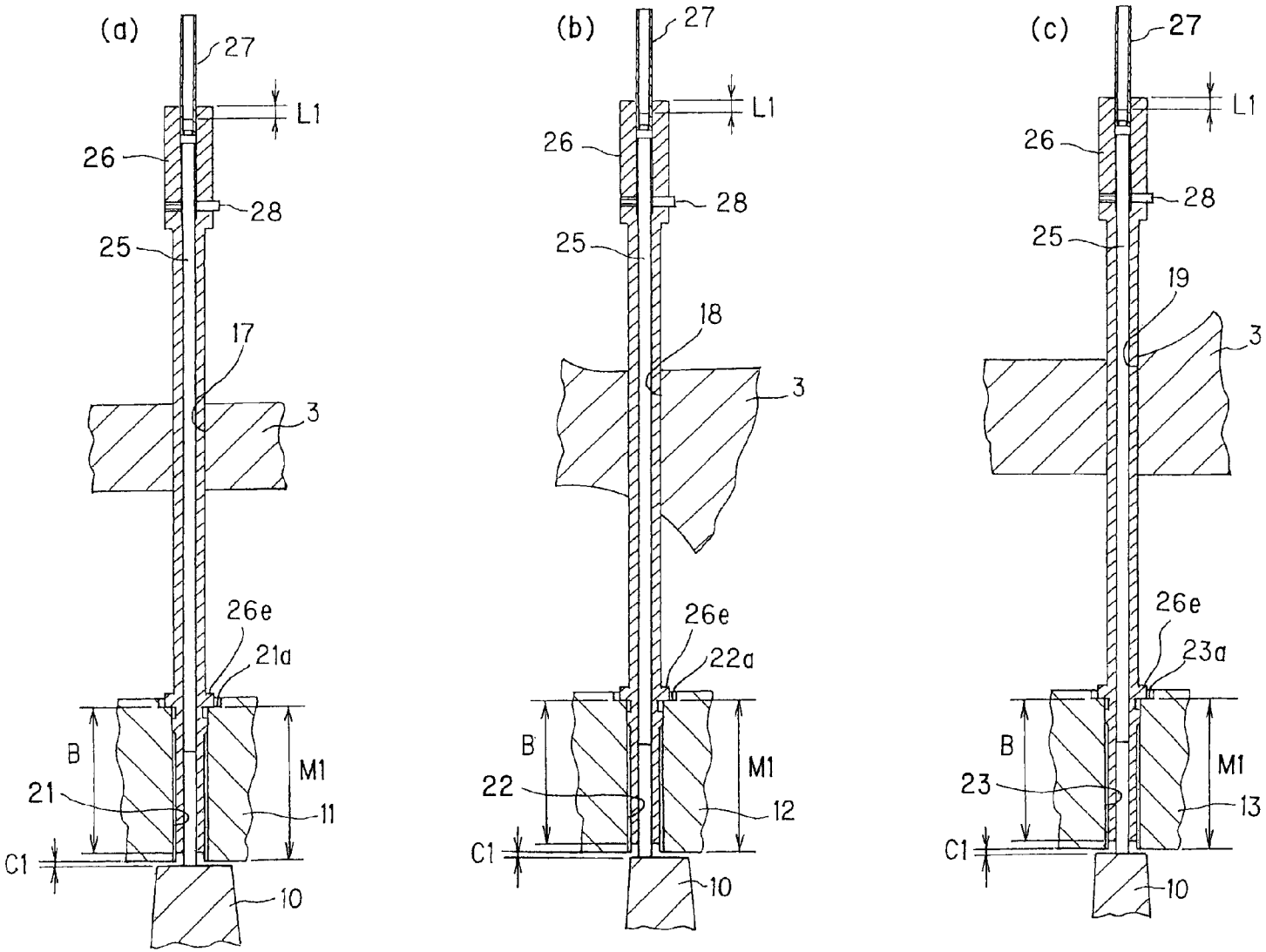
FIGS. 2(*a*) to 2(*c*) are views showing the vane tip management structure for a gas turbine according to the embodiment of the present invention, in which FIG. 2(*a*) is an enlarged view of a section I in FIG. 1, FIG. 2(*b*) is an enlarged view of a section II in FIG. 1, and FIG. 2(*c*) is an enlarged view of a section III in FIG. 1.
Figure 3:
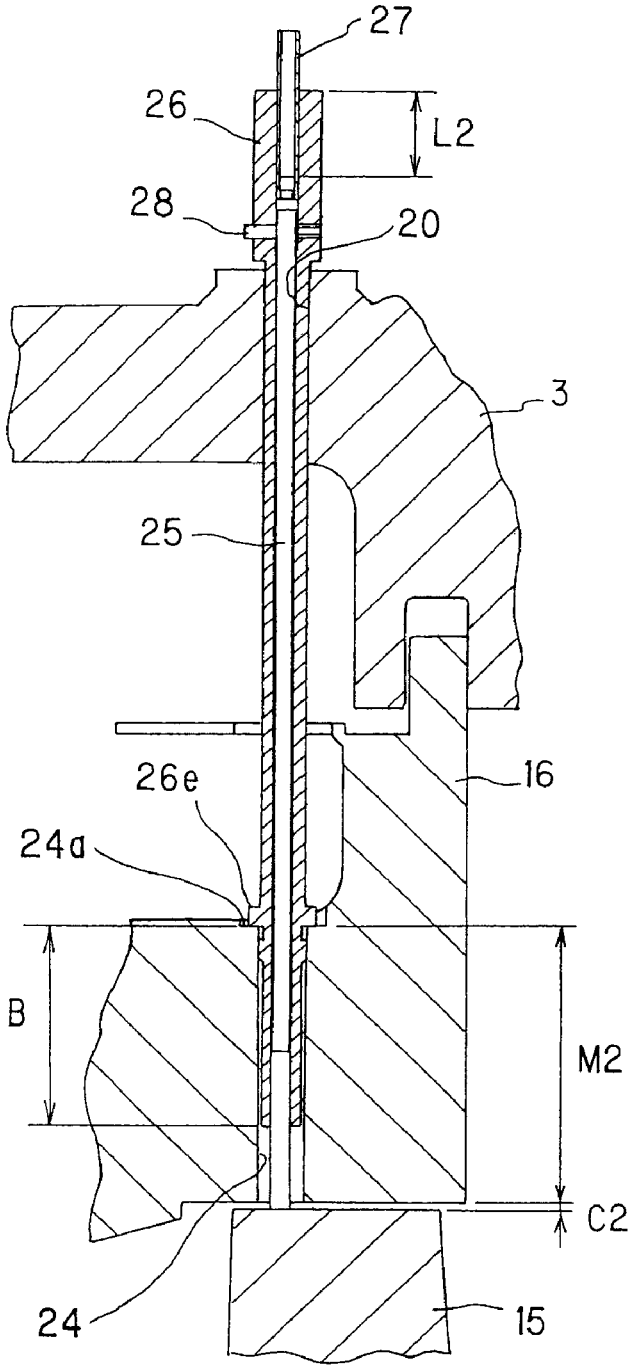
FIG. 3 is a view showing the vane tip management structure for a gas turbine according to the embodiment of the present invention, which is an enlarged view of a section IV in FIG. 1.
Figure 4:
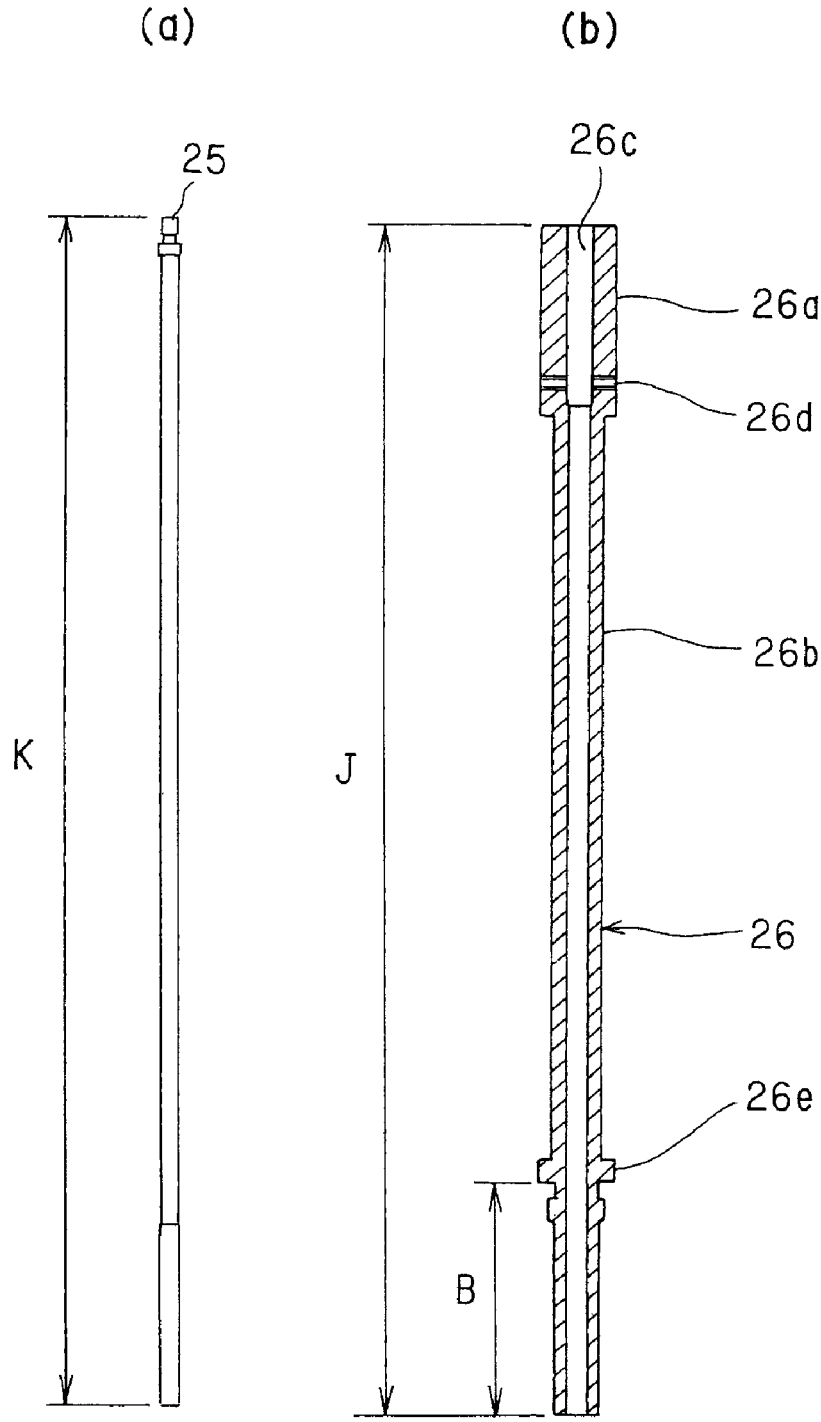
FIG. 4(*a*) is a schematic drawing of a rod and FIG. 4(*b*) is a sectional side view of a guide frame.

FIG. 1 is a sectional side view of a gas turbine provided with a vane tip management structure for a gas turbine according to an embodiment of the present invention. FIG. 2(*a*) is an enlarged view of a section I in FIG. 1. FIG. 2(*b*) is an enlarged view of a section II in FIG. 1. FIG. 2(*c*) is an enlarged view of a section III in FIG. 1. FIG. 3 is an enlarged view of a section IV in FIG. 1. FIG. 4(*a*) is a schematic drawing of a rod. FIG. 4(*b*) is a sectional side view of a guide frame. Note that FIGS. 2 and 3 are views showing the vane tip management structure for a gas turbine according to the embodiment of the present invention.

As shown in FIG. 1, a gas turbine 1 is provided with a rotating rotor 2 and a tubular casing (an outer casing) for rotatably supporting this rotor 2, and an air intake 4 is provided on a front end of this casing 3. Moreover, a compressor 5 is provided on a front end side of the casing 3 whereas a turbine 6 is provided on a rear end thereof, and a combustor 8 is supported by the casing 3 and disposed in a cylinder 7 formed between this compressor 5 and the turbine 6.

The compressor 5 is provided with stator vanes 9 and rotor vanes 10 which are alternately disposed at a given interval from the front side, and is also provided with a first stator vane retainer ring (an inner casing) 11, a second stator vane retainer ring (an inner casing) 12, and a third stator vane retainer ring (an inner casing) 13, which are in annular shapes and are supported concentrically with the casing 3. Moreover, base ends of the stator vanes 9 on respective steps are supported by a corresponding one of a rear end of the air intake 4, the casing 3, and the stator vane retainer rings 11, 12, and 13. A predetermined amount of clearance is formed between each of tips of the stator vanes 9 and the rotor 2. Meanwhile, base ends of the rotor vanes 10 on the respective steps are respectively supported by the rotor 2. A predetermined amount of a clearance C1 (see FIGS. 2(*a*) to 2(*c*)) or a so-called tip clearance is formed between each of tips of the rotor vanes 10 and any of the casing 3 and the stator retainer rings 11, 12, and 13.

In the meantime, the turbine 6 is provided with stator vanes 14 and rotor vanes 15 which are alternately disposed at a given interval from the front side, and is also provided with a turbine vane ring (an inner casing) 16 which is in an annular shape and is supported concentrically with the casing 3. Moreover, base ends of the stator vanes 14 on respective steps are respectively supported by the turbine vane ring 16. A predetermined amount of clearance is formed between each of tips of the stator vanes 14 and the rotor 2. Meanwhile, base ends of the rotor vanes 15 on the respective steps are respectively supported by the rotor 2. A predetermined amount of a clearance C2 (see FIG. 3) or a so-called tip clearance is formed between each of tips of the rotor vanes 15 and the turbine vane ring 16.

Accordingly, introduced air Ao that is introduced from the air intake 4 is compressed by the compressor 5, and the compressed air A thus compressed is guided to the cylinder 7. Then, the compressed air A introduced to the cylinder 7 flows into an upstream side of the combustor 8 and is mixed with liquid fuel F supplied into the combustor 8 to be combusted. Subsequently, combustion gas G generated by this combustion is guided from a downstream side of the combustor 8 to the turbine 6. The turbine 6 exerts a drive force by expanding this combustion gas G, and transmits the drive force to the compressor 5 and other unillustrated external devices such as a power generator.

Next, the vane tip management structure and a vane tip management method for a gas turbine, according to the embodiment of the present invention will be described with reference to FIGS. 2 to 4.

Firstly, the vane tip management structure will be described. As shown in FIGS. 2(*a*), 2(*b*), and 2(*c*), the casing 3 is provided with outer holes 17, 18, and 19 each of which are opened in four places in a circumferential direction thereof (each of FIGS. 2(*a*) to 2(*c*) shows one of them). Meanwhile, the stator vane retainer rings 11, 12, and 13 are provided with inner holes 21, 22, and 23 each of which are opened in four places in a circumferential direction thereof (each of FIGS. 2(*a*) to 2(*c*) shows one of them). Moreover, hole positions of the outer holes 17, 18, and 19 and the inner holes 21, 22, and 23 are located so as to face one another in a radial direction (a radial direction of a rotor shaft) of the casing 3 and the stator vane retainer rings 11, 12, and 13, and to each coincide with phases of the rotor vanes 10 in the circumferential directions thereof. Meanwhile, each of the inner holes 21, 22, and 23 includes a stepped portion (a supporting surface) 21*a*, 22*a*, and 23*a* located on an outer peripheral surface side of the stator vane retainer ring 11, 12 or 13. The thickness from this stepped portion 21*a*, 22*a* or 23*a* to an inner peripheral surface of the stator vane retainer ring 11, 12 or 13 is formed into a length M1.

As shown in FIG. 3, the casing 3 is provided with outer holes 20 which are opened in six places in the circumferential direction thereof (FIG. 3 shows one of them). Meanwhile, the turbine vane ring 16 is provided with inner holes 24 which are opened in six places in the circumferential direction thereof (FIG. 3 shows one of them). Moreover, hole positions of the outer holes 20 and the inner holes 24 are located so as to face one another in the radial direction (the radial direction of the rotor shaft) of the casing 3 and the turbine vane ring 16, and to each coincide with the phases of the rotor vanes 15 in the circumferential directions thereof. Meanwhile, each of the inner holes 24 includes a stepped portion (a supporting surface) 24*a* located on an outer peripheral surface side of the turbine vane ring 16. The thickness from this stepped portion 24*a* to an inner peripheral surface of the turbine vane ring 16 is formed into a length M2.

Moreover, in the vane tip management structure of this embodiment, a rod 25 and a guide frame 26 are provided as shown in FIGS. 4(*a*) and 4(*b*). As shown in FIG. 4(*a*), the rod 25 is formed into a rod shape having a length in an axial direction equivalent to a length K. Meanwhile, as shown in FIG. 4(*b*), the guide frame 26 is formed into a tubular shape having a length in an axial direction equivalent to a length J, and includes a large diameter portion 26*a* on a base end side and a small diameter portion 26*b* on a tip side having a smaller diameter than this large diameter portion 26*a*. A through hole 26*c* for allowing insertion of the rod 25 is formed in the center of the guide frame 26. A screw hole 26*d* communicating with this through hole 26*c* is formed in the large diameter portion 26*a* whereas a flange portion 26*e* is formed on the small diameter portion 26*b*. Moreover, a length from a lower surface of this flange portion 26*e* to a tip of the small diameter portion 26*b* is formed into a length B.

Specifically, in a space between the casing 3 and the stator vane retainer ring 11, 12 or 13, the guide frame 26 is disposed so as to penetrate the outer hole 17, 18 or 19 and the inner hole 21, 22 or 23. At this time, the lower surface of the flange portion 26*e* abuts on the stepped portion 21*a*, 22*a* or 23*a*. Accordingly, it is possible to restrict movement of the guide frame 26 inward in the radial direction (toward the rotor 2). Moreover, it is possible to insert the rod 25 to the through hole 26*c* by supporting the guide frame 26 as described above. In the meantime, in a space between the casing 3 and the turbine vane ring 16, the guide frame 26 is disposed so as to penetrate the outer hole 20 and the inner hole 24. At this time, the lower surface of the flange portion 26*e* abuts on the stepped portion 24*a*. Accordingly, it is possible to restrict movement of the guide frame 26 inward in the radial direction (toward the rotor 2). Moreover, it is possible to insert the rod 25 to the through hole 26*c* by supporting the guide frame 26 as described above.

Next, the vane tip management method, that is, a method of measuring the clearances C1 and C2 will be described. First, after final assembly of the gas turbine 1 (shaft center alignment of the casing 3, the stator vane retainer rings 11, 12, and 13, and the turbine vane ring 16), the rotor 2 is rotated such that the hole positions of the outer holes 17, 18, 19, and 20 as well as the inner holes 21, 22, 23, and 24 in the radial direction coincide with the phases of the rotor vanes 10 and 15. Then, as shown in FIGS. 2(*a*), 2(*b*), and 2(*c*), the guide frame 26 is inserted from the outer peripheral surface side of the casing 3 to the outer hole 17, 18 or 19 and to the inner hole 21, 22 or 23 until the lower surface of the flange portion 26*e* abuts on the stepped portion 21*a*, 22*a* or 23*a*. Subsequently, an extension 27 is screwed on a base end of the rod 25 and the rod 25 is inserted to the through hole 26*c* in this state, thereby allowing a tip of the rod 25 to abut on a tip of the rotor vane 10. Moreover, a setscrew 28 is screwed on the screw hole 25*d* to fix the rod 25, and then the extension 27 is detached. Subsequently, the length L1 from the base end of the guide frame 26 to the base end of the rod 25 is measured. Then, the clearance C1 is calculated by the following formula (1) on the basis of the preset lengths M1, K, J, and B:

$$C1=L1-(M1-B)-(J-K) \quad (1)$$

Similarly, as shown in FIG. 3, the guide frame 26 is inserted from the outer peripheral surface side of the casing 3 to the outer hole 20 and to the inner hole 24 until the lower surface of the flange portion 26*e* abuts on the stepped portion 24*a*. Subsequently, the extension 27 is screwed on the base end of the rod 25 and the rod 25 is inserted to the through hole 26*c* in this state, thereby allowing the tip of the rod 25 to abut on a tip of the rotor vane 15. Moreover, the setscrew 28 is screwed on the screw hole 26*d* to fix the rod 25, and then the extension 27 is detached. Subsequently, the length L2 from the base end of the guide frame 26 to the base end of the rod 25 is measured. Then, the clearance C2 is calculated by the following formula (2) on the basis of the preset lengths M2, K, J, and B:

$$C2=L2-(M2-B)-(J-K) \quad (2)$$

That is, the length from the tip of the guide frame 26 to any of the inner peripheral surfaces of the stator vane retainer rings 11, 12, and 13 as well as the inner peripheral surface of the turbine vane ring 16 (amounts of projection of the rods 25) is calculated by (M1-B) or (M2-B), and a difference between the lengths of the rod 25 and the guide frame 26 is calculated by (J-K) Then, it is possible to calculate the clearance C1 or C2 by subtracting both of the above calculated figures from the length L1 or L2 indicating the length from the base end of the guide frame 26 to the base end of the rod 25, that is, the sinking amount (the amount of movement) of the rod 25 toward the rotator vane 10 or 15. Therefore, by applying the above-described configuration, it is possible to confirm the clearances C1 and C2 easily after completing the assembly of the gas turbine by geometrically calculating the formulas (1) and (2).

Thus, according to the vane tip clearance management structure for a gas turbine of the present invention, provided are: the casing 3 configured to support the rotor 2 rotatably; the stator vane retainer rings 11, 12, and 13, as well as the turbine vane ring 16 provided with predetermined amounts of clearances from the tips of the rotor vanes 10 and 15 fitted in multiple steps to the rotor 2, on the inner side of the casing 3 in the radial direction; the guide frames 26 which penetrate the casing 3, the stator vane retainer rings 11, 12, and 13, and the turbine vane ring 16 in the radial direction and are supported by the stepped portions 21*a*, 22*a*, 23*a*, and 24*a*; and the rods 25 which are movably supported by the guide frames 26 and which abut on the tips of the rotor vanes 10 and 15. Here, the clearances C1 and C2 are each measured by subtracting the length (M1-B) or (M2-B) and also subtracting the length difference (J-K) between the rod 25 and the guide frame 26, from the amount of movement L1 or L2 of the rod 25 relative to the guide frame 26. Here, the lengths (M1-B) and (M2-B) indicate the lengths from the tips of the guide frames 26 to the inner peripheral surfaces of the stator vane retainer rings 11, 12, and 13 as well as the turbine vane ring 16, the lengths calculated by using the stepped portions 21*a*, 22*a*, 23*a* and 24*a* as a basis. In this way, it is possible to confirm the vane tip clearances easily at the time of completing the assembly of the gas turbine.

INDUSTRIAL APPLICABILITY

The present invention is applicable to management of clearance between a rotor and a stationary body which is supported so as to cover an outer periphery of this rotor.

The invention claimed is:

1. A vane tip clearance management structure for a gas turbine, comprising:

an outer casing rotatably supporting a rotor;

an inner casing provided so as to have a predetermined clearance from tips of rotor vanes which are fitted in multiple steps to the rotor on the inner side of the casing in the radial direction, said inner casing having a hole opening in a radial direction, said hole including a stepped portion located on an outer peripheral surface side of said inner casing;

a guide frame having a large diameter portion and a small diameter portion and a screw hole, which communicates with a through hole formed in the center of the guide frame, is formed in the large diameter portion and a flange portion formed on the small diameter portion, in which said small diameter portion of said guide frame penetrating the outer casing and the inner casing in the radial direction and a lower portion of said flange portion being supported by said stepped portion of the inner casing; and a rod, which is inserted in said through hole, is movably supported by the guide frame so as to allow said rod to be fixed by a setscrew provided in the screw hole when said rod abuts on the tip of the rotor vane, and wherein the predetermined clearance formed between said inner casing and said tips of said rotor vanes is based on a length of the guide frame, a length of the rod, a thickness of the inner casing, and the amount of movement of the rod relative to the guide frame.

2. The vane tip clearance management structure for a gas turbine according to claim 1, wherein:

the predetermined clearance formed between said inner casing and said tips of said rotor vanes is based on subtracting a difference between a length from a tip of the guide frame to an inner peripheral surface of the inner casing obtained based on the stepped portion and a length from the guide frame to the rod, from the amount of movement of the rod relative to the guide frame.

3. A vane tip clearance management method for a gas turbine, comprising:

providing an outer casing to rotatably support a rotor;

providing an inner casing so as to provide a predetermined clearance from tips of rotor vanes which are fitted in multiple steps to the rotor on the inner side of the casing in the radial direction;

providing a hole opening in a radial direction of said inner casing;

locating a stepped portion in said hole on an outer peripheral surface side of said inner casing;

providing a guide frame having a large diameter portion and a small diameter portion and a screw hole, which communicates with a through hole in the center of the guide frame, is formed in the large diameter portion and a flange portion formed on the small diameter portion, in which said small diameter portion of said guide frame penetrating the outer casing and the inner casing in the radial direction and a lower portion of said flange portion abutting said stepped portion of the inner casing; and inserting a rod in said through hole so as to be movably supported by the guide frame and allowing said rod to be fixed by a setscrew provided in the screw hole when said rod abuts on the tip of the rotor vane, and forming the predetermined clearance between said inner casing and said tips of said rotor vanes based on subtracting a difference between a length from a tip of the guide frame to an inner peripheral surface of the inner casing obtained based on said stepped portion and a length from the guide frame to the rod, from the amount of movement of the rod relative to the guide frame.

* * * * *